US012753990B1

(12) United States Patent
Barker

(10) Patent No.: US 12,753,990 B1
(45) Date of Patent: Oct. 6, 2026

(54) FIREARM BRACKET

(71) Applicant: James Barker, Poplar Bluff, MO (US)

(72) Inventor: James Barker, Poplar Bluff, MO (US)

( * ) Notice: Subject to any disclaimer, the term of this patent is extended or adjusted under 35 U.S.C. 154(b) by 0 days.

(21) Appl. No.: 18/221,167

(22) Filed: Jul. 12, 2023

Related U.S. Application Data

(60) Provisional application No. 63/389,722, filed on Jul. 15, 2022.

(51) Int. Cl.
*F41C 27/00* (2006.01)

(52) U.S. Cl.
CPC ..... *F41C 27/00* (2013.01)

(58) Field of Classification Search
CPC .... F41G 11/001; F41G 11/002; F41G 11/003; F41G 11/004; F41C 27/00
See application file for complete search history.

(56) References Cited

U.S. PATENT DOCUMENTS 4,195,432 A * 4/1980 Hickman ..... F41A 21/08 42/106
8,371,056 B1 * 2/2013 Baker ..... F41G 11/003 42/106
8,393,108 B1 * 3/2013 Wilson ..... F41G 11/003 42/111
8,739,452 B1 * 6/2014 Calvert ..... F41G 11/004 42/106
8,857,096 B2 * 10/2014 Mcclintock ..... F41G 11/003 42/72
9,273,930 B2 * 3/2016 Jiminez ..... F41G 11/003
9,470,480 B2 * 10/2016 Kirchhoff ..... F41G 11/001
9,574,840 B1 * 2/2017 Sisk ..... F41C 23/16
9,599,438 B1 * 3/2017 Fravor ..... F41G 11/003
9,719,755 B2 * 8/2017 Klotz ..... F41C 27/00
D806,818 S * 1/2018 Major ..... D22/108
10,551,142 B1 2/2020 Wright
11,402,170 B2 * 8/2022 Gurule ..... F41A 21/485
2010/0263255 A1 * 10/2010 Harris ..... F41C 27/00 42/90
2011/0131859 A1 * 6/2011 Lawson ..... F41G 11/003 42/90
2011/0225865 A1 9/2011 Williams
(Continued)

*Primary Examiner* — Joshua E Freeman
(74) *Attorney, Agent, or Firm* — MALLOY & MALLOY, PL

(57) ABSTRACT

A firearm bracket suitable for mounting a pistol to a rifle may include a bracket body. At least one rifle attachment rail slot may be provided in the bracket body. The rifle attachment rail slot may facilitate attachment of the firearm bracket to a rifle attachment rail on a rifle. At least one pistol opening may extend through the bracket body. The pistol opening may be suitably sized and configured to receive the barrel of at least one pistol. Accordingly, in typical application of the firearm bracket, the rifle attachment rail on the rifle may engaged with the rifle attachment rail slot in the bracket body. The barrel of the pistol may be extended through the pistol opening in the bracket body. The user of the firearm bracket may grasp the rifle grip on the rifle with one hand and the pistol grip on the pistol with the other hand to achieve better stability and comfort and ready firing access to both the rifle and the pistol during target practice, hunting, law enforcement or military exercises.

7 Claims, 7 Drawing Sheets

(56) References Cited

U.S. PATENT DOCUMENTS

| | | | | |
|---|---|---|---|---|
| 2014/0047755 | A1* | 2/2014 | Mcclintock | F41G 11/003 42/90 |
| 2014/0157644 | A1* | 6/2014 | Jiminez | F41G 11/003 42/114 |
| 2014/0252187 | A1* | 9/2014 | Petrovic | F16B 2/185 248/229.16 |
| 2015/0253090 | A1* | 9/2015 | Kirchhoff | F41G 11/001 42/71.01 |
| 2016/0178299 | A1* | 6/2016 | Cassels | F41A 5/28 89/193 |
| 2017/0261288 | A1* | 9/2017 | Bartoszewicz | F41G 11/003 |
| 2018/0003465 | A1* | 1/2018 | Sessions | F41G 11/003 |
| 2018/0356174 | A1 | 12/2018 | Balenger | |
| 2022/0163292 | A1* | 5/2022 | Kilic | F41G 11/003 |
| 2023/0392902 | A1* | 12/2023 | Tiller | F41C 27/00 |

* cited by examiner

FIREARM BRACKET

FIELD OF THE INVENTION

The present invention relates generally to firearms, and more particularly, to a firearm bracket suitable for mounting a pistol to a rifle.

BACKGROUND OF THE INVENTION

Firearms are extensively used for hunting, recreation, law enforcement and military exercises. Pistols, or short guns, are carried by law enforcement personnel. Long guns include single-shot rifles which require manual reloading of a round after each round is fired, as well as semiautomatic rifles, which are automatically reloaded each time the trigger is pulled. Many long guns, particularly semiautomatic rifles, can be customized with various accessories. In some applications, one or more accessory rails may be fitted on the barrel of the rifle to facilitate attachment of the accessories to the rifle. An upper rail, a lower rail, or both upper and lower rails may be provided on the rifle barrel to enable the user to attach such accessories as a sighting scope and/or a pistol grip to the barrel, with the sighting scope typically attached to the upper rail and the pistol grip attached to the lower rail. Each accessory rail may include a standard pair of rail flanges which insert into companion grooves in each accessory that is attached to the rail.

A pistol grip provides a front grip in addition to the standard rear hand grip for a user of a rifle. During operation of the rifle, the front hand grip and the rear pistol grip provide a greater degree of control over movement and aiming of the rifle to a user than does the single standard rear hand grip alone. The pistol grip may increase the stability of the firearm as it is fired, thus increasing the accuracy of the firearm. Additionally, pistol grips are added to provide additional comfort for the user while shooting. Other common weapon accessories include laser pointers, flashlights, and scopes.

In law enforcement and military applications, personnel may carry both a rifle and a pistol. The primary weapon may be used for long-range combat, whereas the secondary weapon may be used in close range. Moreover, in the event that one of the firearms malfunctions, the other may be used until the other weapon is repaired or replaced.

Accordingly, there is need for a firearm bracket suitable for mounting a pistol to a rifle in some applications.

SUMMARY OF THE INVENTION

The present invention is directed to a firearm bracket suitable for mounting a pistol to a rifle. The firearm bracket may include a bracket body. At least one rifle attachment rail slot may be provided in the bracket body. The rifle attachment rail slot may facilitate attachment of the firearm bracket to a rifle attachment rail on a rifle. At least one pistol opening may extend through the bracket body. The pistol opening may be suitably sized and configured to receive the barrel of at least one pistol. Accordingly, in typical application of the firearm bracket, the rifle attachment rail on the rifle may engaged with the rifle attachment rail slot in the bracket body. The barrel of the pistol may be extended through the pistol opening in the bracket body. The user of the firearm bracket may grasp the rifle grip on the rifle with one hand and the pistol grip on the pistol with the other hand to achieve better stability and comfort and ready firing access to both the rifle and the pistol during target practice, hunting, law enforcement or military exercises.

In an illustrative implementation of the invention, a firearm bracket suitable for mounting a pistol to a rifle may include a bracket body. At least one rifle attachment rail slot may be provided in the bracket body. The rifle attachment rail slot may facilitate attachment of the firearm bracket to a rifle attachment rail on a rifle. At least one pistol opening may extend through the bracket body. The pistol opening may be suitably sized and configured to receive the barrel of at least one pistol. At least one pistol attachment rail slot may be provided in the bracket body in communication with the pistol opening. The pistol attachment rail slot may be suitably sized and configured to accept a pistol attachment rail on the barrel of the pistol. Accordingly, in typical application of the firearm bracket, the rifle attachment rail on the rifle may engaged with the rifle attachment rail slot in the bracket body. The barrel of the pistol may be extended through the pistol opening in the bracket body as the pistol attachment rail engages the companion pistol attachment rail slot. The user of the firearm bracket may grasp the rifle grip on the rifle with one hand and the pistol grip on the pistol with the other hand to achieve better stability and comfort and ready firing access to both the rifle and the pistol during target practice, hunting, law enforcement or military exercises.

In a second aspect, the bracket body may include a bottom bracket body wall, a pair of spaced-apart side bracket body walls extending from the bottom bracket body wall and a top bracket body wall extending between the side bracket body walls.

In another aspect, the pistol opening may have an interior pistol opening surface. The pistol attachment rail slot may extend into the interior pistol opening surface.

In another aspect, the pistol attachment rail slot may extend into the bottom bracket body wall of the bracket body.

In another aspect, the firearm bracket may have a modular design to facilitate coupling of multiple pistols to each other in sequence for easier transport and storage of the pistols.

In another aspect, at least one exterior bracket attachment rail may extend along the bracket body. The bracket attachment rail may facilitate attachment of at least one firearm accessory to the firearm bracket and/or attachment of two or more firearm brackets to each other for coupling of multiple pistols to each other.

In another aspect, the at least one bracket attachment rail may include a bottom bracket attachment rail which extends from the bottom bracket body wall of the bracket body.

In another aspect, the bottom bracket attachment rail may include a bottom rail base extending from the bottom bracket body wall, a bottom rail head extending from the bottom rail base and a pair of elongated, parallel, spaced-apart bottom rail flanges extending along the bottom rail head.

In another aspect, a plurality of spaced-apart bottom rail ridges may be provided on the bottom rail head of the bottom bracket attachment rail.

In another aspect, the at least one bracket attachment rail may include at least one side bracket attachment rail extending from at least one of the side bracket body walls of the bracket body.

In another aspect, the at least one side bracket attachment rail may include a pair of side bracket attachment rails extending from the respective side bracket body walls of the bracket body.

In another aspect, each side bracket attachment rail may include a side rail base extending from the corresponding side bracket body wall, a side rail head extending from the side rail base and a pair of elongated, parallel, spaced-apart side rail flanges extending along the side rail head.

In another aspect, a plurality of spaced-apart side rail ridges may be provided on the side rail head of each side bracket attachment rail.

In another aspect, the rifle attachment rail slot may include an inner slot portion and a pair of elongated, parallel, spaced-apart side slot portions extending from the inner slot portion.

In another aspect, the rifle attachment rail slot may be provided in a rifle slot housing on the bracket body.

In another aspect, the rifle slot housing may include a housing base extending outwardly from the bracket body and a pair of spaced-apart side housing portions extending from the housing base. The rifle attachment rail slot may be formed by and between the housing base and the side housing portions of the rail slot housing.

In another aspect, the inner slot portion of the rifle attachment rail slot may extend along the housing base and the side slot portions of the rifle attachment rail slot may extend along the respective side housing portions of the rail slot housing.

In another aspect, the housing base of the rifle slot housing may extend from the top bracket body wall of the bracket body.

In another aspect, at least one pistol set screw opening may extend laterally into the bracket body. Each pistol set screw opening may communicate with the pistol attachment rail slot. Each pistol set screw opening may accept a threaded set screw which engages the pistol attachment rail on the pistol barrel of the pistol to secure the pistol barrel in the pistol opening.

In another aspect, at least one rifle set screw opening may extend laterally into the bracket body. Each rifle set screw opening may communicate with the rifle attachment rail slot. Each rifle set screw opening may accept a set screw which engages the rifle attachment rail on the rifle barrel of the rifle to secure the rifle attachment rail in the rifle attachment rail slot.

In another aspect, the pistol attachment rail slot may include an inner slot portion and a pair of elongated, parallel, spaced-apart side slot portions extending from the inner slot portion.

In another aspect, the bracket body may have an elongated, cylindrical bracket body wall.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
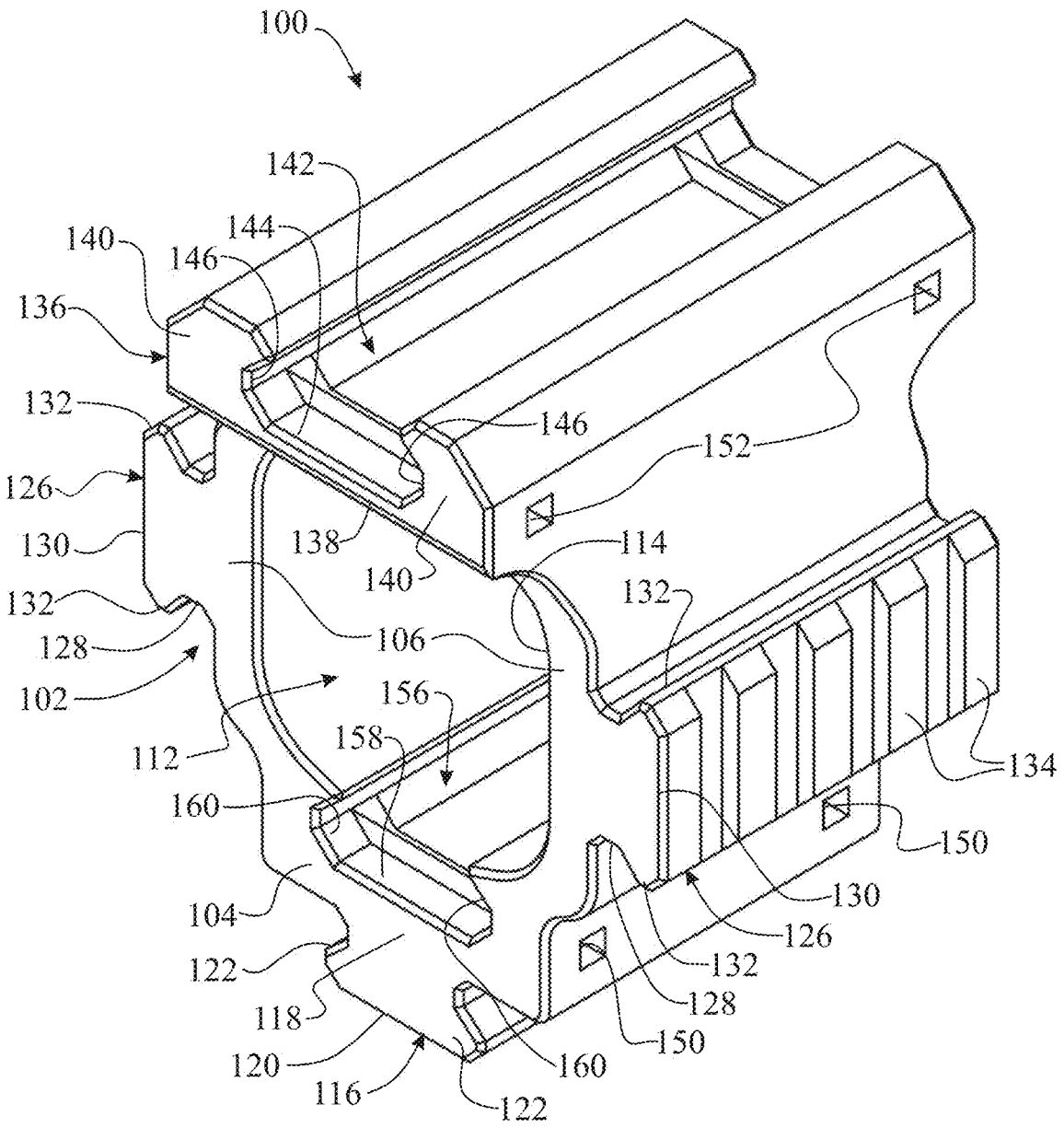
FIG. 1 presents a perspective view of a firearm bracket in accordance with a first illustrative embodiment of the present invention.
Figure 2:
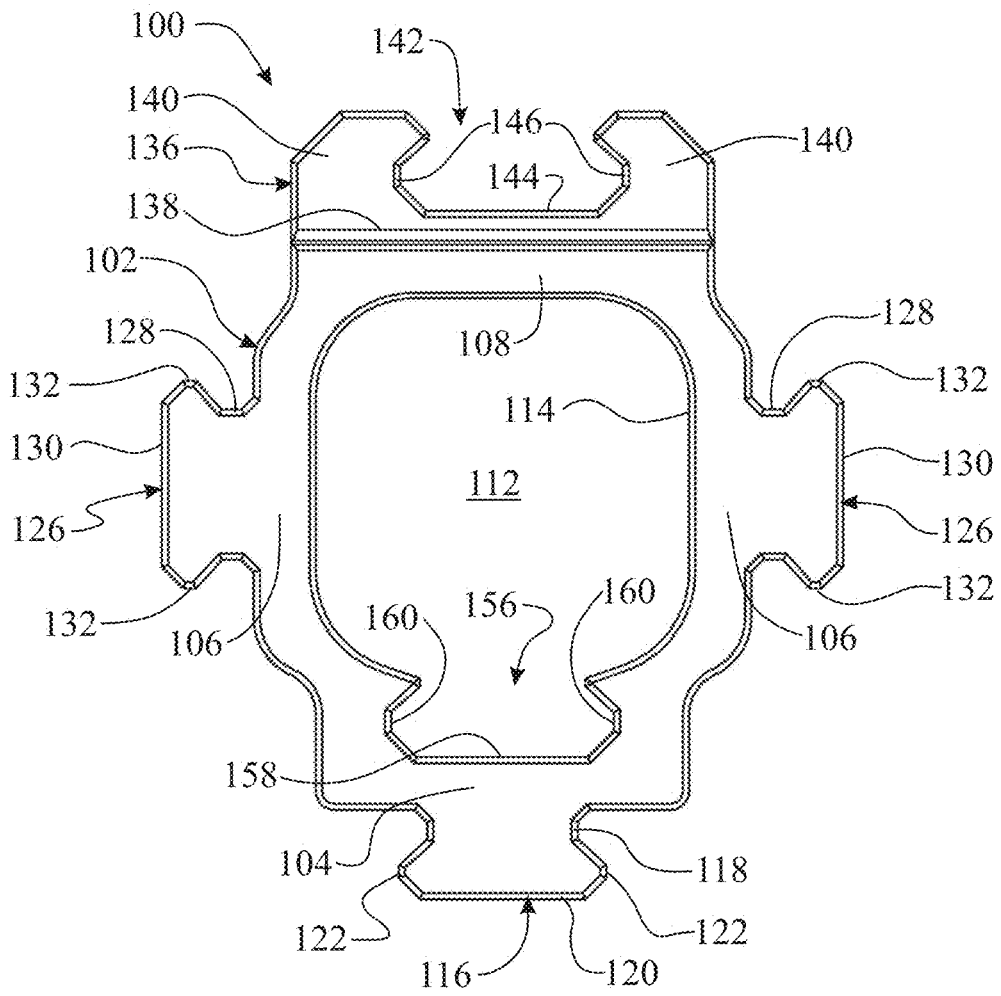
FIG. 2 presents a front view of the firearm bracket illustrated in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a firearm bracket suitable for mounting a pistol to a rifle.

Referring initially to FIGS. 1-8, a firearm bracket, hereinafter firearm bracket 100, is illustrated in accordance with a first exemplary embodiment of the present invention. As shown for instance in FIG. 1, the firearm bracket 100 may include a bracket body 102. The bracket body 102 may be fabricated of stainless steel, aluminum, plastic, composite materials and/or other materials which are consistent with the functional requirements of the firearm bracket 100. At least one rifle attachment rail slot 142 may be provided in the bracket body 102. The rifle attachment rail slot 142 may facilitate attachment of the firearm bracket 100 to a rifle attachment rail (not illustrated) on a rifle. In some embodiments, the rifle attachment rail on the rifle may be a standard or conventional picatinny rail or may have Q-lock mechanical attachment capability. At least one pistol opening 112 may extend through the bracket body 102. The pistol opening 112 may be suitably sized and configured to receive the barrel (not illustrated) of at least one pistol. Accordingly, in typical application of the firearm bracket 100, the rifle attachment rail on the rifle may engaged with the rifle attachment rail slot 142 in the bracket body 102. The barrel of the pistol may be extended through the pistol opening 112 in the bracket body 102. The user of the firearm bracket 100 may grasp the rifle grip on the rifle with one hand and the pistol grip on the pistol with the other hand to achieve better stability and comfort and ready firing access to both the rifle and the pistol during target practice, hunting, law enforcement or military exercises.

In some embodiments, at least one pistol attachment rail slot 156 may be provided in the bracket body 102 in communication with the pistol opening 112. The pistol attachment rail slot 156 may be suitably sized and configured to accept a pistol attachment rail (not illustrated) on the barrel of the pistol. Accordingly, the pistol attachment rail may engage the companion pistol attachment rail slot 156 as the barrel of the pistol is extended through the pistol opening in the bracket body 102.

In some embodiments, the bracket body 102 may include a bottom bracket body wall 104. A pair of spaced-apart side bracket body walls 106 may extend from the bottom bracket body wall 104. A top bracket body wall 108 may extend between the side bracket body walls 106.

As illustrated in FIG. 1, the pistol opening 112 may have an interior pistol opening surface 114. Accordingly, the pistol attachment rail slot 156 may extend into the interior pistol opening surface 114.

In some embodiments, the pistol attachment rail slot 156 may extend into the bottom bracket body wall 118 of the bracket body 102. In some embodiments, the pistol attachment rail slot 156 may extend into a side bracket body wall 106 or the top bracket body wall 108 of the bracket body 102.

In some embodiments, the firearm bracket 100 may have a modular design to facilitate coupling of multiple pistols to each other in sequence for easier transport and storage of the pistols. Accordingly, at least one exterior bracket attachment rail 116, 126 may extend along the bracket body 102. Each bracket attachment rail 116, 126 may facilitate attachment of at least one firearm accessory (not illustrated) to the firearm bracket 100. Additionally, or alternatively, each bracket attachment rail 116, 126 may facilitate attachment of two or more additional firearm brackets 100 to each other. Accordingly, additional pistols (not illustrated) may be supported by the additional firearm brackets 100 to facilitate transportation and/or storage of multiple pistols.

In some embodiments, the bracket attachment rails 116, 126 may include a bottom bracket attachment rail 116. The bottom bracket attachment rail 116 may extend from and along the bottom bracket body wall 104 of the bracket body 102.

In some embodiments, the bottom bracket attachment rail 116 may have a standard or conventional picatinny design or may have Q-lock mechanical attachment capability. The bottom bracket attachment rail 116 may have a bottom rail base 118 which extends from the bottom bracket body wall 104. A bottom rail head 120 may extend from the bottom rail base 118. A pair of elongated, parallel, spaced-apart bottom rail flanges 122 may extend along the bottom rail head 120. A plurality of spaced-apart bottom rail ridges 124 may be provided on the bottom rail head 120 of the bottom bracket attachment rail 116.

In some embodiments, the bracket attachment rail 116, 126 may include at least one side bracket attachment rail 126. The side bracket attachment rail 126 may extend from at least one of the side bracket body walls 106 of the bracket body 102. In some embodiments, a pair of side bracket attachment rails 126 may extend from the respective side bracket body walls 106 of the bracket body 102, as illustrated.

In some embodiments, each side bracket attachment rail 126 may have a standard or conventional picatinny rail design or may have Q-lock mechanical attachment capability. Each side bracket attachment rail 126 may have a side rail base 128 which extends from the corresponding side bracket body wall 106. A side rail head 130 may extend from the side rail base 128. A pair of elongated, parallel, spaced-apart side rail flanges 132 may extend along the side rail head 130. A plurality of spaced-apart side rail ridges 134 may be provided on the side rail head 130 of each side bracket attachment rail 126.

In some embodiments, the rifle attachment rail slot 142 may be suitably sized and configured to receive and interlock with a standard or conventional picatinny rifle attachment rail (not illustrated) or may have Q-lock mechanical attachment capability. The rifle attachment rail slot 142 may include an inner slot portion 144. A pair of elongated, parallel, spaced-apart side slot portions 146 may extend from the inner slot portion 144.

In some embodiments, the rifle attachment rail slot 142 may be provided in a rifle slot housing 136 on the bracket body 102. The rifle slot housing 136 may include a housing base 138 which extends outwardly from the bracket body 102. A pair of spaced-apart side housing portions 140 may extend from the housing base 138. The rifle attachment rail slot 142 may be formed by and between the housing base 138 and the side housing portions 140 of the rail slot housing 136. In some embodiments, the housing base 138 of the rifle slot housing 136 may extend from the top bracket body wall 108 of the bracket body 102, as illustrated.

In some embodiments, the inner slot portion 144 of the rifle attachment rail slot 142 may extend along the housing base 138. The side slot portions 146 of the rifle attachment rail slot 142 may extend along the respective side housing portions 140 of the rail slot housing 136.

Figure 3:
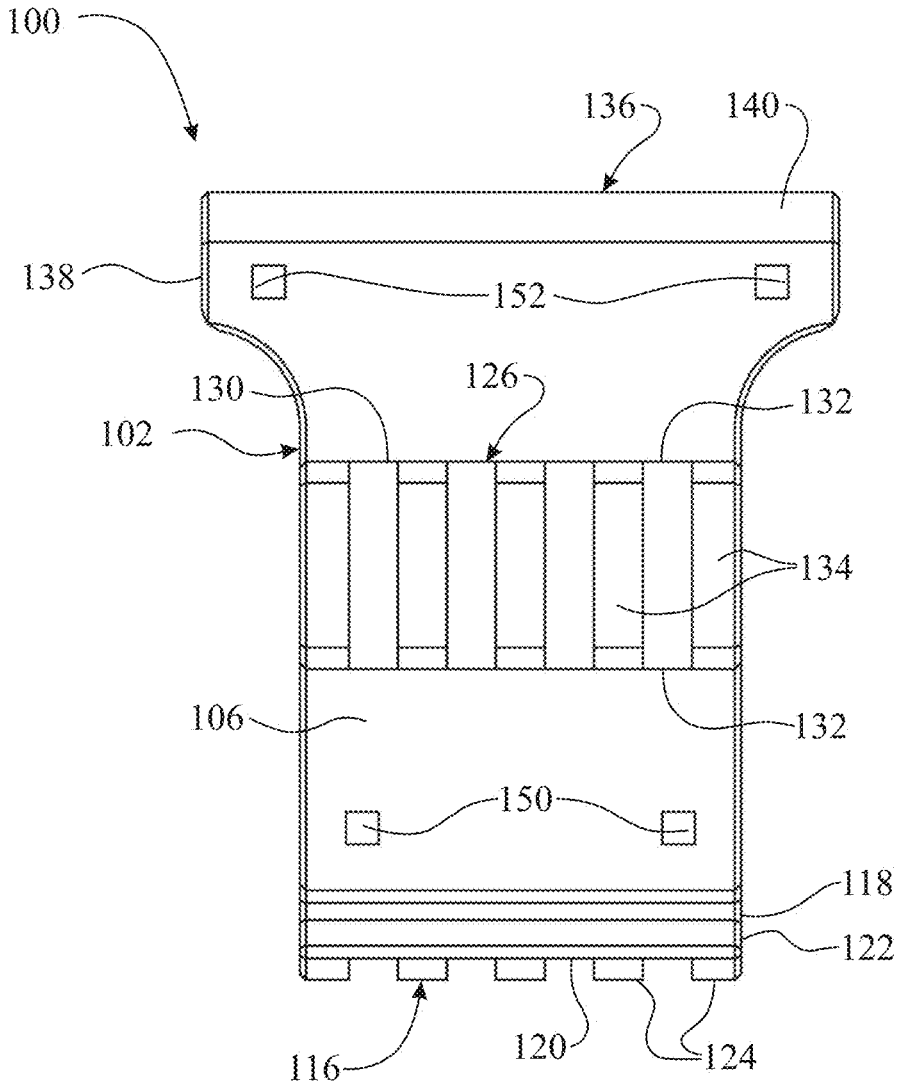
FIG. 3 presents a side view of the firearm bracket illustrated in FIG. 1.
Figure 4:
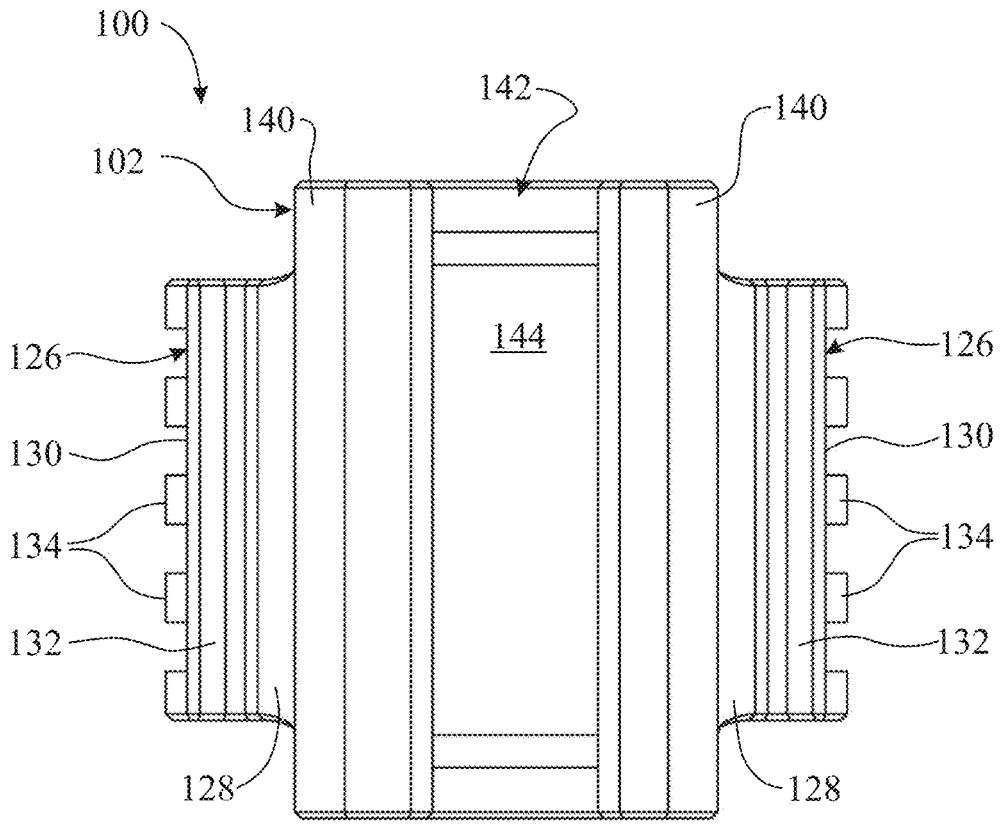
FIG. 4 presents a top view of the firearm bracket illustrated in FIG. 1.
Figure 5:
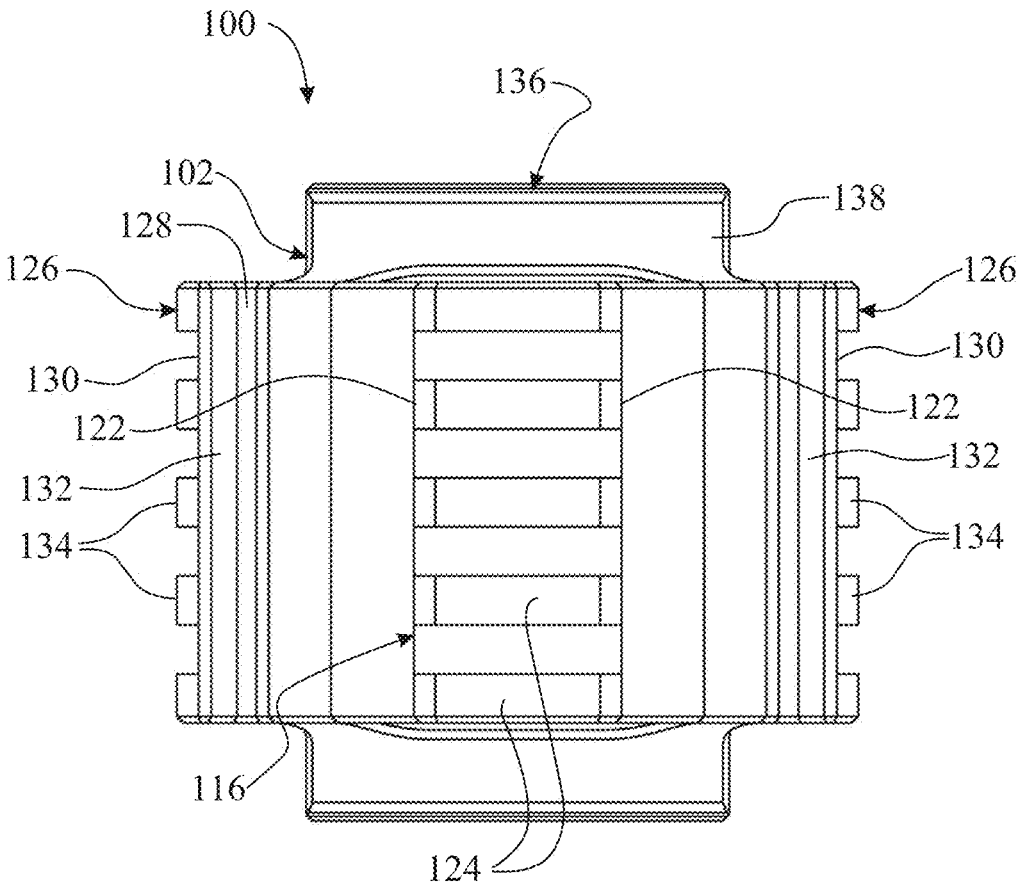
FIG. 5 presents a bottom view of the firearm bracket illustrated in FIG. 1.

As illustrated in FIGS. 1 and 3, at least one pistol set screw opening 150 may extend laterally into the bracket body 102. Each pistol set screw opening 150 may communicate with the pistol attachment rail slot 156. Each pistol set screw opening 150 may accept a threaded set screw (not illustrated) which engages the pistol attachment rail (not illustrated) on the pistol barrel of the pistol to secure the pistol barrel in the pistol opening 112.

In some embodiments, at least one rifle set screw opening 152 may extend laterally into the bracket body 102. Each rifle set screw opening 152 may communicate with the rifle attachment rail slot 142. Each rifle set screw opening 152 may accept a set screw (not illustrated) which engages the rifle attachment rail (not illustrated) on the rifle barrel of the rifle to secure the rifle attachment rail in the rifle attachment rail slot 142.

As illustrated in FIG. 1, in some embodiments, the pistol attachment rail slot 156 may be suitably sized and configured to receive and interlock with a standard or conventional picatinny rifle attachment rail (not illustrated) or a rifle attachment rail with Q-lock mechanical attachment capability. Accordingly, the pistol attachment rail slot 156 may include an inner slot portion 158. A pair of elongated, parallel, spaced-apart side slot portions 160 may extend from the inner slot portion 158.

In typical application of the firearm bracket 100, the rifle attachment rail (not illustrated) on the rifle may be engaged with the rifle attachment rail slot 142 in the bracket body 102. Accordingly, the proximal or distal end of the rifle attachment rail may be slid into an end of the rifle attachment rail slot 142 and the firearm bracket 100 slid along the rifle attachment rail until the firearm bracket 100 is at the desired location along the length of the rifle attachment rail. The set screws (not illustrated) may be threaded into the respective rifle set screw openings 152 and tightened against the rifle attachment rail to secure the firearm bracket 100 at the desired position on the rifle attachment rail. In some embodiments, at least one barrel clamp (not illustrated) may be used to secure the firearm bracket 100 to the barrel of the rifle.

The barrel of the pistol may be extended through the pistol opening 112 in the bracket body 102 of the firearm bracket 100. The set screws (not illustrated) may be threaded into the respective pistol set screw openings 150 and tightened against the pistol attachment rail to secure the pistol barrel of the pistol in the pistol opening 112. The user of the firearm bracket 100 may grasp the rifle grip (not illustrated) on the rifle with one hand and the pistol grip on the pistol with the other hand. Accordingly, the firearm bracket 100 may enable the user to achieve better stability and comfort and ready firing access to both the rifle and the pistol during target practice, hunting, law enforcement or military exercises.

In some applications, at least one firearm accessory (not illustrated) may be attached to the bottom bracket attachment rail 116 and/or to one or both side bracket attachment rails 126. Additionally, or alternatively, one or more additional firearm brackets 100 may be attached to the bottom bracket attachment rail 116 and/or to one or both of the side bracket attachment rails 126. This may be accomplished by inserting the bottom bracket attachment rail 116 or side bracket attachment rail 126 in the rifle attachment rail slot 142 of each additional firearm bracket or brackets 100 and inserting and securing the pistol barrel of the additional pistol or pistols in the pistol opening 112 of each additional firearm bracket 100. Accordingly, the additional pistol or pistols (not illustrated) may be supported by the additional firearm brackets 100 to facilitate transportation and/or storage of the pistols.

Figure 6:
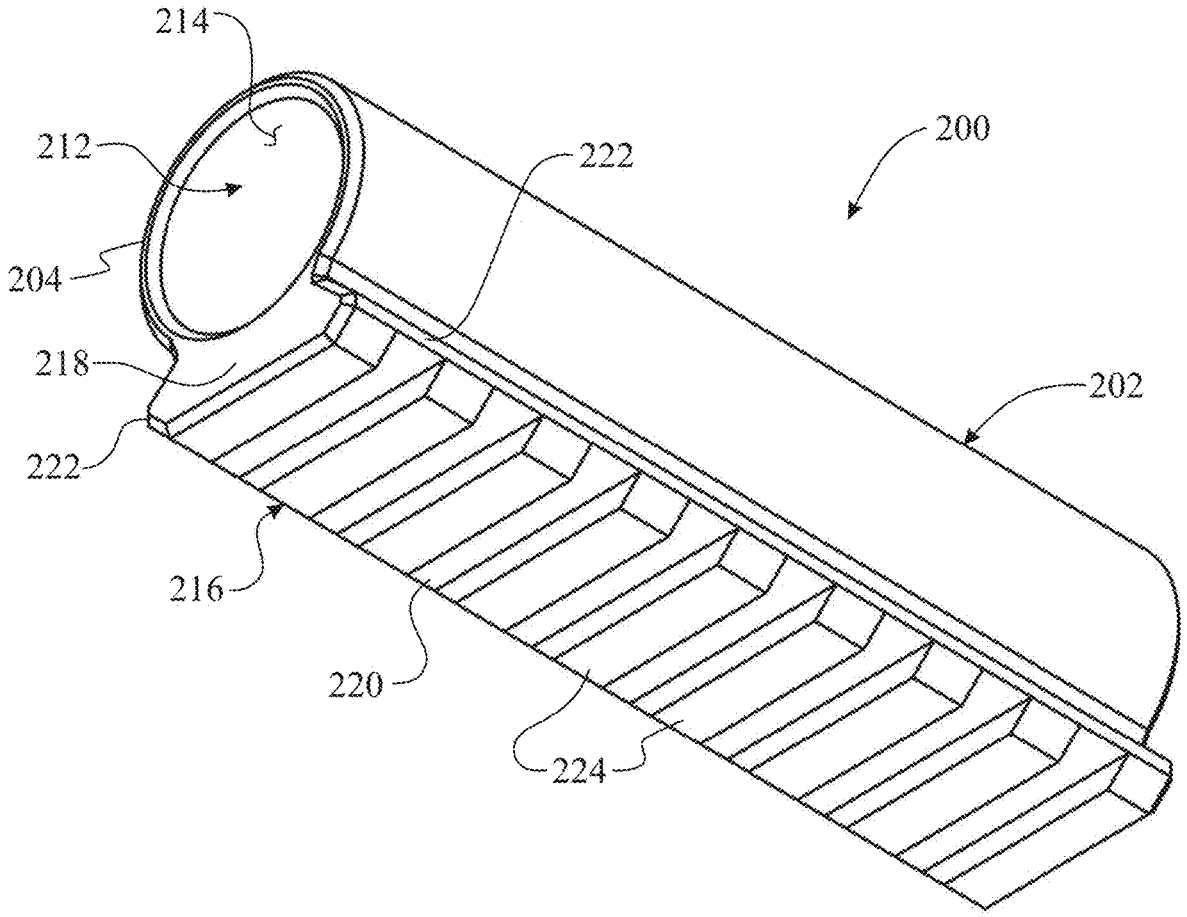
FIG. 6 presents a bottom perspective view of a firearm bracket in accordance with a second illustrative embodiment of the present invention.
Figure 7:
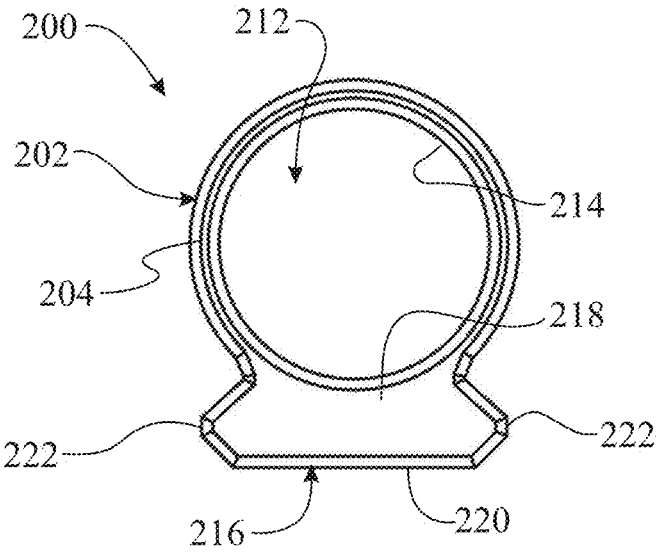
FIG. 7 presents a front view of the firearm bracket illustrated in FIG. 6.
Figure 8:
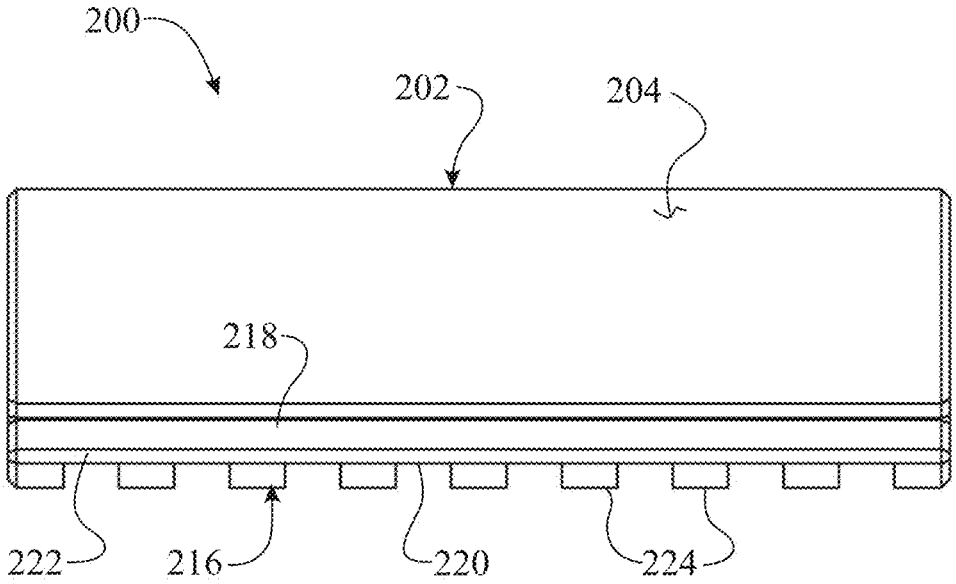
FIG. 8 presents a side view of the firearm bracket illustrated in FIG. 6.

Referring next to FIGS. 6-8, an alternative illustrative embodiment of the firearm bracket is generally indicated by reference numeral 200. In the firearm bracket 200, elements which are analogous to the respective elements of the firearm bracket 100 that was heretofore described with respect to FIGS. 1-5 are designated by the same respective numerals in the 200-299 series in FIGS. 6-8. In the firearm bracket 200, the bracket body 202 may have an elongated, cylindrical bracket body wall 204. At least one attachment rail 216 may extend along the bottom bracket body wall 204 of the bracket body 202.

In typical application of the firearm bracket 200, the pistol barrel (not illustrated) of the pistol may be inserted into the pistol opening 212 of the bracket body 202. At least one firearm accessory (not illustrated) may be attached to the attachment rail 216. Alternatively, the attachment rail 216 may be used to facilitate attachment of the firearm bracket 200 to a rifle (not illustrated) typically by inserting the attachment rail 216 into a companion rail slot on the rifle barrel of the rifle.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A firearm bracket suitable for mounting a pistol to a rifle, comprising:

a bracket body including a bottom bracket body wall, a pair of spaced-apart side bracket body walls extending from the bottom bracket body wall, and a top bracket body wall extending between the side bracket body walls;

at least one rifle attachment rail slot in the bracket body, the at least one rifle attachment rail slot configured to facilitate attachment of the firearm bracket to a rifle attachment rail on a rifle, including a locking mechanism;

wherein the rifle attachment rail slot is provided in a rifle slot housing on the bracket body, the rifle slot housing including a housing base extending outwardly from the bracket body and a pair of spaced-apart side housing portions extending longitudinally from the housing base, and wherein the rifle attachment rail slot is formed by and between the housing base and the side housing portions, with an inner slot portion extending along the housing base and a pair of elongated, parallel, spaced-apart side slot portions extending along the respective side housing portions;

at least one pistol opening extending through the bracket body, the at least one pistol opening suitably sized and configured to receive a barrel of at least one pistol, wherein the pistol opening includes a pistol attachment rail slot for securing the pistol to the bracket, the pistol opening including an interior pistol opening surface, and the pistol attachment rail slot extending into the interior pistol opening surface and into the bottom bracket body wall, further including a tension adjustment mechanism comprising a set screw disposed in communication with the pistol attachment rail slot, the set screw being received in a pistol set screw opening extending laterally into the bracket body, the set screw being configured to engage a pistol attachment rail on the pistol barrel to apply variable compressive force based on the size and configuration of the pistol; and at least one exterior bracket attachment rail extending along the bracket body, including a pair of side bracket attachment rails extending from the respective side bracket body walls, each side bracket attachment rail having a side rail base, a side rail head, and a pair of elongated, parallel, spaced-apart side rail flanges extending along the side rail head, with a plurality of spaced-apart side rail ridges provided on the side rail head, and a bottom bracket attachment rail extending from the bottom bracket body wall, the bottom bracket attachment rail including a bottom rail base, a bottom rail head, a pair of elongated, parallel, spaced-apart bottom rail flanges extending along the bottom rail head, and a plurality of spaced-apart bottom rail ridges on the bottom rail head.

2. The firearm bracket of claim 1, wherein the firearm bracket includes a modular design to facilitate coupling of multiple pistols to each other in sequence for easier transport and storage of the pistols.

3. The firearm bracket of claim 1, wherein at least one exterior bracket attachment rail may extend along the bracket body, and further wherein the exterior bracket attachment rail facilitates attachment of at least one firearm accessory to the firearm bracket and/or attachment of two or more firearm brackets to each other for coupling of multiple pistols to each other.

4. The firearm bracket of claim 3, the at least one exterior bracket attachment rail includes a bottom bracket attachment rail which extends from the bottom bracket body wall of the bracket body.

5. The firearm bracket of claim 4, wherein the bottom bracket attachment rail includes a bottom rail base extending from the bottom bracket body wall, a bottom rail head extending from the bottom rail base and a pair of elongated, parallel, spaced-apart bottom rail flanges extending along the bottom rail head.

6. The firearm bracket of claim 5, wherein a plurality of spaced-apart bottom rail ridges are provided on the bottom rail head of the bottom bracket attachment rail.

7. The firearm bracket of claim 1, wherein at least one pistol set screw opening extends laterally into the bracket body, each pistol set screw opening communicating with the pistol attachment rail slot such that each pistol set screw opening accepts a threaded set screw which engages the pistol attachment rail on the pistol barrel of the pistol to secure the pistol barrel in the pistol opening.

* * * * *